US006791905B1

(12) United States Patent
Sekiguchi

(10) Patent No.: US 6,791,905 B1
(45) Date of Patent: Sep. 14, 2004

(54) TIMEPIECE

(75) Inventor: Kanetaka Sekiguchi, Sayama (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/831,906

(22) PCT Filed: Nov. 26, 1999

(86) PCT No.: PCT/JP99/06627

§ 371 (c)(1),
(2), (4) Date: May 25, 2001

(87) PCT Pub. No.: WO00/31596

PCT Pub. Date: Jun. 2, 2000

(30) Foreign Application Priority Data

Nov. 26, 1998 (JP) ..... 10-335193

(51) Int. Cl.[7] ..... G04B 19/04; G04B 1/00; G04C 19/00

(52) U.S. Cl. ..... 368/80; 368/82; 368/205

(58) Field of Search ..... 368/64, 66, 80, 368/82, 203–205, 223, 228, 239; 136/244, 246, 251, 252, 257

(56) References Cited

U.S. PATENT DOCUMENTS

| | | | | |
|---|---|---|---|---|
| 5,438,556 A | * | 8/1995 | Dinger et al. | 368/205 |
| 5,761,158 A | | 6/1998 | Azuma et al. | |
| 5,880,796 A | * | 3/1999 | Sonoda et al. | 349/61 |

FOREIGN PATENT DOCUMENTS

| | | |
|---|---|---|
| GB | 2 320 356 | 6/1998 |
| JP | 51-13362 | 1/1976 |
| JP | 53-82463 | 7/1978 |
| JP | 55-16239 | 2/1980 |
| JP | 55-86982 | 6/1980 |
| JP | 59-116079 | 7/1984 |
| JP | 61-161791 | 10/1986 |
| JP | 61-114056 | 7/1988 |
| JP | 5-45474 | 2/1993 |
| JP | 7-294667 | 11/1995 |
| JP | 7-336011 | 12/1995 |
| JP | 8-334572 | 12/1996 |
| JP | 9-54177 | 2/1997 |
| JP | 9-274085 | 10/1997 |
| JP | 9-326498 | 12/1997 |
| JP | 10-186064 | 7/1998 |

OTHER PUBLICATIONS

European Search report dated Feb. 19, 2002.

* cited by examiner

*Primary Examiner*—Vit Miska
(74) *Attorney, Agent, or Firm*—Westerman, Hattori, Daniels & Adrian, LLP

(57) ABSTRACT

A timepiece is provided with a solar cell 8 comprising a power generation unit 39, having a first electrode, a photovoltaic layer, and a second electrode, stacked up in that order on the solar cell substrate 31 so as to be superimposed on each other, and electric power generated by the solar cell 8 is used as an energy source for executing time display on a time display unit by a dial 14 and hands 5, 6 or a liquid crystal display panel 50. The solar cell 8 is constructed such that a plurality of the power generation units 39, and transmitting portions 40 having a transmittance of light, larger than that for the power generation units, are alternately patterned on a solar cell substrate 31, and is disposed on the visible side of the time display unit so as to be superimposed thereon, thereby ensuring satisfactory power generation efficiency of the solar cell without impairing visibility of the time display unit, and without introducing restrictions on the design feature of the timepiece.

42 Claims, 10 Drawing Sheets

TIMEPIECE

TECHNICAL FIELD

The present invention relates to a timepiece comprising a time display unit for displaying time and a calendar, and a solar cell for generating electric power utilizing light as an energy source, wherein electric power generated by the solar cell is used as an energy source for displaying time on the time display unit.

BACKGROUND TECHNOLOGY

A battery has been in use traditionally as a power source of an electronic wrist watch and the like, however, owing to inconvenience in replacement of the battery and needs to overcome environmental pollution problems and so forth caused by waste batteries, there has recently come to be commercially available and in widespread use an electronic wrist watch wherein needs of replacing a battery are eliminated by assembling therein a solar cell, a secondary cell, and a charge-discharge control circuit for the secondary cell.

With a timepiece incorporating such a solar cell as power generation means, electric power generated by the solar cell through conversion of radiated optical energy into electric energy is stored in the secondary cell, and a clock circuit and so forth, and a stepping motor or a liquid crystal display panel are driven by the electric power as stored, thereby displaying time and calendar information in the form of analog display by use of a dial and hands, or digital display by use of the liquid crystal display panel.

The solar cell incorporated in such a timepiece is provided with power generation units, each formed by a first electrode, an optical power generation layer, and a second electrode that are stacked up in that order on a solar cell substrate in such a way as to be superimposed on each other. The solar cell substrate has transmitting portions, however, the transmitting portions are provided for the purpose of separating the power generation units from each other or connecting the same with each other, but not for positively ensuring transmitting property.

Accordingly, assuming that the visible side (a viewer's side) of a time display unit of the timepiece is referred to as the front side while the back cover side thereof is referred to as the rear side, the solar cell is generally disposed on the rear side of the time display unit, or on the periphery thereof.

Further, a configuration of the timepiece has been proposed such that in order to shield a color of the solar cell substrate detrimental to a design feature of the timepiece incorporating the solar cell, or to shield a pattern of the power generation units, a shielding film such as a white diffusing film, a color diffusing film, a color filter, and so forth are disposed on the front side of the solar cell substrate, thereby shielding the solar cell substrate so as not to be directly visible.

In the case of installing the solar cell on the underside of the time display unit of the timepiece, however, it becomes necessary to keep a proper balance between the design feature and power generation efficiency because the solar cell substrate becomes visible through the time display unit or the shielding film is used on top of the solar cell substrate in order to shield the solar cell substrate. Use of a shielding film having a large optical absorption coefficient results in considerable deterioration of the power generation efficiency while use of a shielding film having a small optical absorption coefficient results in deterioration of the shielding effect of the solar cell substrate.

Further, in the case of installing the solar cell on top of the time display unit, the design feature of the timepiece would be largely dependent on a color and shape of the power generation units because, in this case, the transmitting portions only are installed over the time display unit without the power generation units installed thereon, and the power generation units are installed on the periphery of the time display unit for generation of electric power.

In this case as well, it is possible to shield a color tone or the pattern of the power generation units by installing a shielding film on top of the power generation units of the solar cell, however, in such a case, due to an increase in the difference of transmittance between the surface of the time display unit and the power generation units, the power generation units of the solar cell is distinctly recognized against the transmitting portions thereof, thereby subjecting the design feature of the timepiece to some constraints.

The invention has been developed to solve the problems described above encountered in the case of a timepiece provided with a solar cell, and it is therefore an object of the invention to provide a timepiece wherein visibility of a time display unit is not impaired even if the solar cell in whole, including power generation units, is installed on the visible side of the time display unit of the timepiece, and power generation units can be rendered inconspicuous so as not to introduce restrictions on the design feature of the timepiece even if no shielding film is installed, while ensuring satisfactory power generation efficiency of the solar cell.

DISCLOSURE OF THE INVENTION

To this end, a timepiece according to the invention comprises a time display unit, and a solar cell comprised of a solar cell substrate, and a power generation unit having at least a first electrode, a photovoltaic layer, and a second electrode, stacked up in that order so as to be superimposed on each other on the solar cell substrate, using electric power generated by the solar cell as an energy source for executing time display in the time display unit; said solar cell comprising a plurality of patterned power generation units provided on the solar cell substrate composed of a transparent material, and transmitting portions having a large transmittance in the visible light range and provided between the plurality of the patterned power generation units, wherein the solar cell is disposed on the visible side of the time display unit so as to be superimposed on the time display unit, the power generating units and the transmitting portions are superimposed on the time display unit, and the time display region is rendered to be recognized through the transmitting regions.

In the case of the time display unit being an analog time display unit having a dial and hands, the solar cell may be disposed on a visible side of the dial.

Or the solar cell may be disposed between the dial and the hands.

Otherwise, the solar cell is preferably provided with the plurality of the patterned power generation units being connected with each other via the respective first electrodes and the respective second electrodes, and the solar cell is preferably disposed between the time display unit and a glass of the timepiece so as to be superimposed on the time display unit.

The solar cell may have regions where transmittance of partial power generation and transmitting units comprised of the respective power generation units in combination with the respective transmitting portions is in a range of 30 to 80%, thereby enabling a condition on the underside of the solar cell substrate to be seen in the regions from a viewer's side.

Further, the solar cell may be constructed such that an area ratio of the respective power generation units installed on the solar cell substrate to the respective transmitting portions adjoining the respective power generation units varies depending on a region on the solar cell substrate.

The solar cell may be constructed such that a plurality of solar cell substrates which vary in area ratio of the respective power generation units installed thereon to the respective transmitting portions adjoining the respective power generation units, are disposed therein.

Otherwise, the solar cell may be constructed such that a plurality of solar cell substrates, each having the power generation unit and the transmitting portion, are stacked up one after another, and are disposed such that transmitting portions of the plurality of the solar cell substrates are superimposed on each other.

A printed layer having numerals or letters may be provided on the solar cell substrate. The printed layer may be a printed layer printed with a plurality of colors.

The solar cell may comprise a design printed layer having numerals or letters provided on the solar cell substrate, and a printed layer provided on the dial as well, the design printed layer on the solar cell substrate and the printed layer on the dial may be disposed so as to be substantially superimposed on each other, and a spacing to the extent of a thickness of the solar cell substrate may be provided between the design printed layer on the solar cell substrate and the printed layer on the dial, so that the printed layer on the dial is rendered recognizable from the visible side through the transmitting portion of the solar cell substrate.

The respective power generation units and the respective transmitting portions provided on the solar cell substrate of the solar cell are preferably disposed repeatedly in the pattern of stripes, and a repeat pitch of the pattern of the stripes may be varied.

At least a portion of the power generation unit provided on the solar cell substrate may incorporate shapes of numerals or letters.

The plurality of the power generation units and the transmitting portions provided on the solar cell substrate of the solar cell may be patterned in concentric circles, and each of the plurality of the power generation units may be in the shape of a concentric circle cut at a part thereof, the plurality of the power generation units being mutually connected with each other at the cut part of the respective concentric circles.

Or the plurality of the power generation units may be formed in a spiral pattern on the solar cell substrate of the solar cell.

The first electrode and the second electrode, installed on the solar cell substrate of the solar cell, composing the power generation unit, may be connected with a clock circuit substrate for causing the time display unit to execute time display via an electrically conductive rubber, a flexible printed circuit board, a spring, or the like that is disposed so as to pass through a spacing between a side of the time display unit, and the inner side wall of a timepiece case.

The timepiece according to the invention may be a combination timepiece comprising the time display unit comprised of both an analog time display unit for displaying time with the hands and the dial, and a digital time display unit for displaying time and a calendar with numerals.

In such a case, the digital time display unit may be composed of a liquid crystal display panel.

For the liquid crystal display panel, use is preferably made of one comprising a reflection type polarizing film having one polarization axis which is a transmission axis and the other polarization axis which is a reflection axis substantially orthogonal to the transmission axis.

A light source is preferably installed on a side of the liquid crystal display panel, opposite from the visible side, as this will enable a viewer to recognize time display even in a dark environment, thereby enhancing usefulness of the timepiece.

The solar cell substrate needs to be provided with a through-hole through which a hand shaft serving as a rotatory shaft of the hands is penetrated A printed layer is preferably provided around the through-hole in the solar cell substrate so as to shield the through-hole.

The solar cell substrate is preferably provided with an alignment portion used for alignment.

Further, the printed layer having numerals or letters is preferably provided on the solar cell substrate, and the alignment portion used for alignment with the time display unit is preferably provided on the solar cell substrate.

A repeat pitch or a repeat direction of the respective power generation units as well as the respective transmitting portions provided on the solar cell substrates is preferably differentiated from a direction of a display part provided on the time display unit or a pitch of a printed layer for prevention of occurrence of moire fringes.

The power generation unit of the solar cell is preferably installed on a face of the solar cell substrate, on a side thereof, facing the time display unit.

A pad electrode serving as a terminal of the first electrode and the second electrode, respectively, composing the power generation unit is preferably installed on a face of the solar cell substrate, on a side thereof, facing the clock circuit substrate.

A protective layer or a protective film is preferably provided on at least either of the front and rear faces of the solar cell substrate.

Either of the front and rear faces of the solar cell substrate is preferably stuck onto a glass of the timepiece to enhance durability of the timepiece.

An anti-reflection layer is preferably installed on at least the transmitting portion of the solar cell substrate.

An optical guide film or a lens for effectively radiating light to the power generation unit may be installed between the solar cell substrate and the dial.

The surface of the dial preferably has a rough face formed for effectively radiating light to the power generation unit of the solar cell substrate.

The surface of the dial may be provided with the printed layer formed for effectively radiating light to the power generation unit of the solar cell substrate.

Two types of solar cells, one of which has an area ratio of the power generation unit to the transmitting portion installed on the solar cell substrate differing from the same of the other, may be installed across the time display unit on both sides thereof.

Thus, with the solar cell for use in the timepiece according to the invention, a power generation unit provided on the solar cell substrate is divided into smaller units, and a transmitting portion having a transmittance of visible light larger than that for the respective power generation units, between the respective power generation units is provided thereby forming partial power generation and transmitting units having transmitting property.

Further, the more a transmittance of the partial power generation and transmitting units comprised of the respective power generation units and respective transmitting portions is enhanced, the more visibility of the time display units can be enhanced, and the more visibility of the power generation units can be lowered, however, power generation efficiency of the solar cell deteriorates.

Conversely, the more the transmittance of the partial power generation and transmitting units is lowered, the less a quantity of external light falling on the time display units becomes, thereby indicating darker display, and lowering the visibility of the time display units while increasing the visibility of the power generation units, however, the power generation efficiency is enhanced.

Accordingly, taking into consideration the visibility of the time display units indoors, the power generation efficiency, and power consumption of the timepiece, it is desirable to set the transmittance of the partial power generation and transmitting units in a range of 30 to 80%.

Further, by providing regions where the transmittance of the partial power generation and transmitting units varies depending on a design and display contents of the time display units installed on the rear side of the solar cell, an area ratio of the transmitting portions may be increased in parts where importance is attached to brightness, and an area ratio of the power generation units may be increased in other parts where importance can be attached to the power generation efficiency, thereby optimally setting the design feature and the power generation efficiency.

The respective transmitting portions provided between the plurality of the power generation units, installed in the partial power generation and transmitting units may be formed in the pattern of stripes, spirals or concentric circles, thereby rendering the solar cell substrate suitable for a design of the timepiece.

Further, by varying a pitch or width of the pattern in which the plurality of the power generation units are formed, occurrence of interference fringes caused by the pattern described above together with display on the rear side of the solar cell substrate can be prevented.

In the case of forming the printed layer having numerals or letters on the solar cell substrate, or forming numerals or letters by the power generation units, it becomes necessary to align the solar cell substrate with other parts of the timepiece, and accordingly, the solar cell substrate is preferably provided with the alignment portion. The alignment portion may be formed by the printed layer provided on the solar cell substrate. Or the solar cell substrate may be provided with a recess and a protrusion, a hole, or a notch as the alignment portion.

BEST MODE FOR CARRYING OUT THE INVENTION

Embodiments of a timepiece according to the invention will be described in more detail hereinafter with reference to the accompanying drawings.

First Embodiment: FIGS. 1 to 6

First, a first embodiment of a timepiece according to the invention is described referring to FIGS. 1 to 6.

Figure 1:
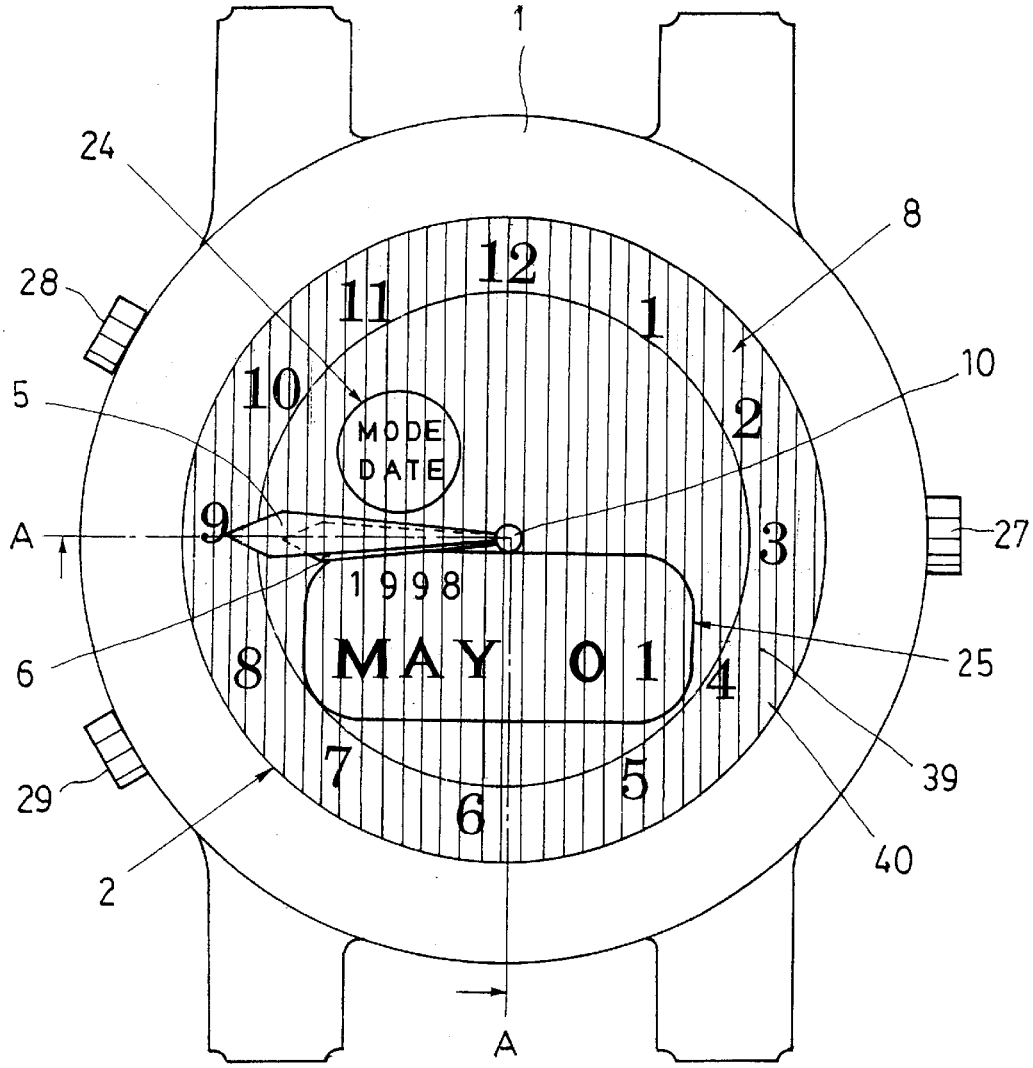
FIG. 1 is a schematic plan view showing a first embodiment of a timepiece according to the invention.
Figure 2:
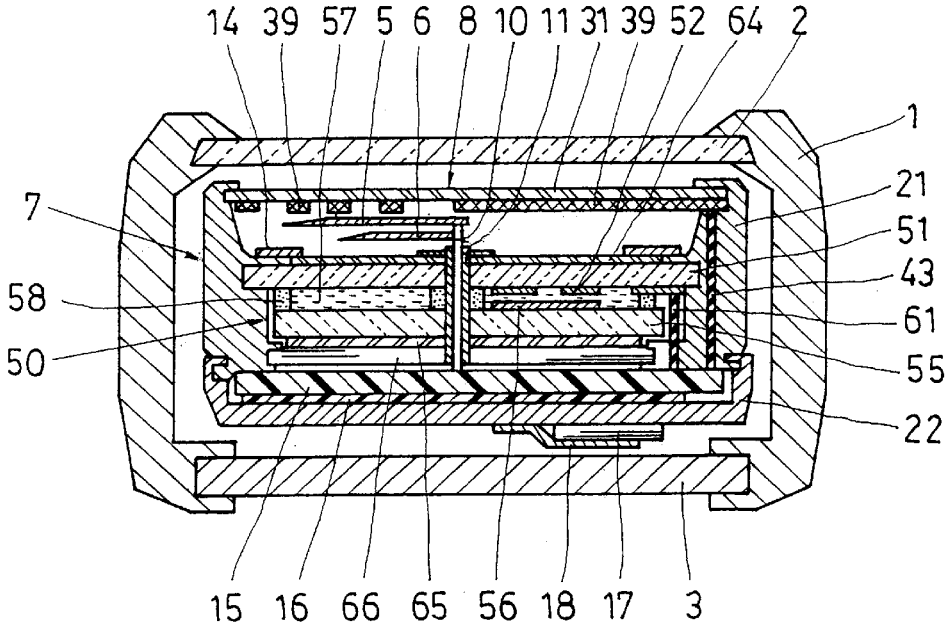
FIG. 2 is a schematic sectional view taken along line A—A of FIG. 1.
Figure 3:
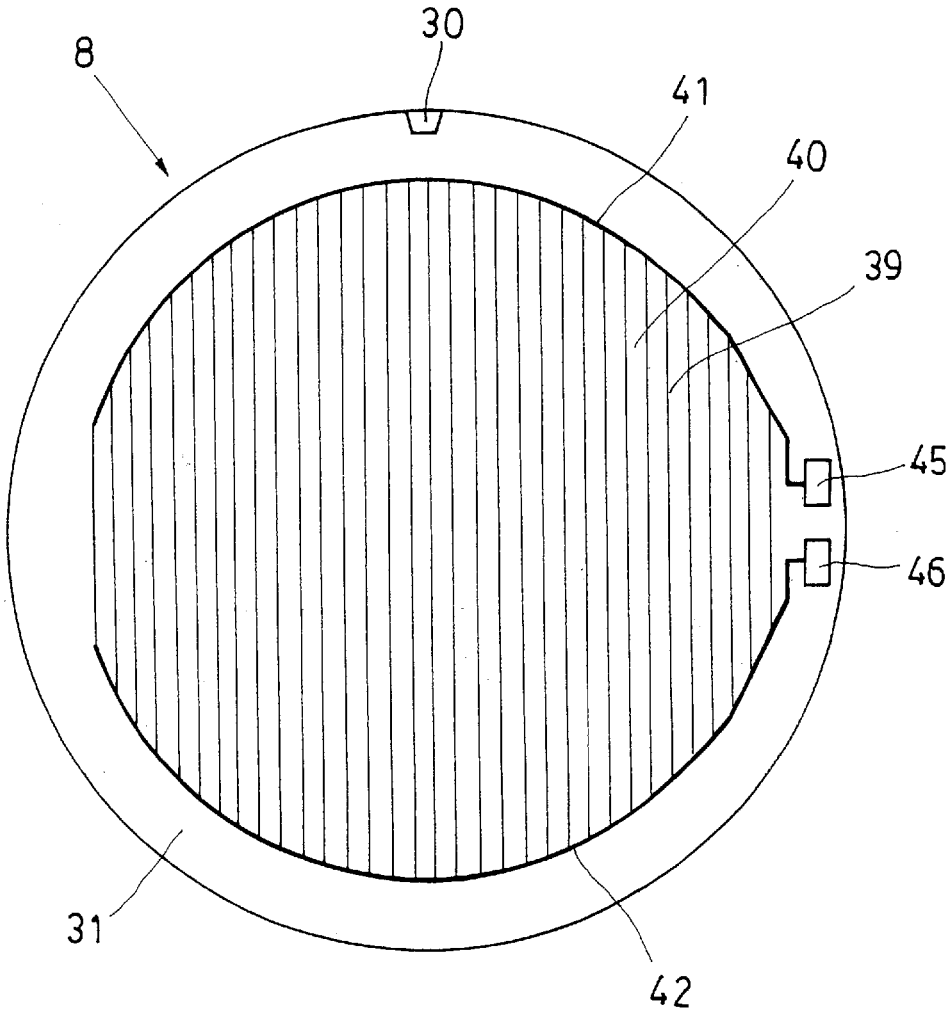
FIG. 3 is a schematic plan view of a solar cell assembled into the timepiece shown in FIGS. 1 and 2.

FIG. 1 is a schematic plan view of the timepiece, and FIG. 2 is a schematic sectional view taken along line A—A of FIG. 1. FIG. 3 is a plan view of a solar cell assembled into the timepiece, FIG. 4 a partly enlarged schematic plan view of the solar cell, and FIG. 5 is an enlarged schematic sectional view taken along line B—B of FIG. 4. FIG. 6 is a block diagram showing a circuit configuration of the timepiece.

The timepiece shown in FIG. 1 and FIG. 2, respectively, is an electronic wrist watch provided with a solar cell, wherein an enclosed space is formed with a timepiece case 1 made of metal, in a cylindrical shape, a glass 2 fitted in and retained by the upper part thereof, and a case back 3 fitted in and retained by the lower part thereof. A timepiece unit 7 is housed in the enclosed space.

As shown in FIG. 1, on the front side (the visible side) of the timepiece, the solar cell 8 in a disk shape is disposed on the inner side of the glass 2 in a circular shape, a liquid crystal display panel 50 with a dial 14 in an annular shape bonded to the surface thereof is disposed on the rear side of the solar cell 8, and hands, that is, the minute hand 5 and the hour hand 6 attached to the tip of a hand shaft 10 are disposed between the liquid crystal display panel 50 and the solar cell 8. The hand shaft 10 is in fact made up of a minute hand shaft and a hour hand shaft fitted onto the outside of the minute hand shaft, however, for convenience of illustration, the hand shaft 10 is shown in the figure as if it were a single hand shaft 10.

Hour numerals from "1" to "12", indicating time, are printed on the dial 14, and a first time display unit for indicating an analog display of time with the hands is comprised of the dial 14, the minute hand 5, and the hour hand 6. The dial 14 also fulfills the function of a dial cover.

The liquid crystal display panel 50 constitutes a second time display unit for indicating a digital display of time and a calendar, and is provided with a mode display portion 24, and a multiple function display portion 25 for displaying time, a calendar, a chronograph, a stopwatch, and so forth (displaying a calendar in the figure) by switching over from one to another, as shown in FIG. 1.

Accordingly, the solar cell 8 is disposed so as to overlap the first time display unit comprised of the dial 14, the minute hand 5 and the hour hand 6, and the second time display unit comprised of the liquid crystal display panel 50, respectively, and between these time display units and the glass 2 installed on the visible side thereof.

The solar cell 8 comprises a multitude of power generation units 39, and a multitude of transmitting portions 40, patterned in alternate stripes on a solar cell substrate 31 (on the rear face side thereof in FIG. 2) as shown in FIG. 1, however, detailed description thereof will be given later on.

Further, as shown in FIG. 1, the timepiece case 1 is provided with a time adjustment knob 27 for adjusting time and so forth, a mode adjustment button 28 for setting a chronograph and so forth, and a light source lighting button 29 for lighting up a light source 66 (refer to FIG. 2) installed on the rear face side of the liquid crystal display panel 50.

As shown in FIG. 2, with the liquid crystal display panel 50 of the timepiece, a first substrate 51, and a second substrate 55, each of which is a transparent substrate, are disposed opposite to each other with a predetermined gap interposed therebetween, and are bonded to each other with a sealing material 58, sealing a liquid crystal layer 57 in the gap. For the liquid crystal layer 57, twisted nematic (TN) liquid crystal having a twist angle of 90 degrees is used.

Further, first electrodes 52 made up of an indium tin oxide (ITO) film which is a transparent and electrically conductive film are formed in the pattern of respective segments for characters and so forth to be displayed, on the inner face of the first substrate 51, and a second electrode 56 made up of an ITO film is installed so as to oppose all of the first electrodes 52.

An upper polarizing film 64 is disposed on the surface (the visible side) of the liquid crystal display panel 50, and a lower polarizing film 65 is disposed on the rear face side (the case back side) thereof.

The upper polarizing film 64 and the lower polarizing film 65 are disposed such that respective transmission axes cross each other at right angles, so that the liquid crystal display panel 50 exhibits a transmitting state when no voltage is applied by the agency of optical rotatory power of the liquid crystal layer 57.

For the upper polarizing film 64, an absorption type polarizing film prepared by adsorbing iodine (I) is used, and for the lower polarizing film 65, use is made of a reflection type polarizing film prepared by stacking a plurality of layers each having a transmission axis and a reflection axis (orthogonal to the transmission axis) and a differing reflective index, respectively. The reflection type polarizing film reflects linearly polarized light vibrating in a direction orthogonal to the transmission axis.

On the rear side of the liquid crystal display panel 50, an electroluminescent (EL) device is installed as the light source 66 for use when using the timepiece in a dark environment.

The liquid crystal display panel 50 and the light source 66 is provided with a hand shaft through-hole 11 through which the hand shaft 10 is penetrated.

The hand shaft 10 is protruded from a hand drive substrate 15 installed on the rear side of the light source 66. A clock circuit substrate 16 is installed on the rear side of the hand drive substrate 15. The clock circuit substrate 16 comprises a time reference signal oscillator (OSC) as described later on, and so forth, sending out a predetermined signal to the hand drive substrate 15 and the liquid crystal display panel 50.

The clock circuit substrate 16 is connected with the liquid crystal display panel 50 via a zebra rubber 61 formed with electrically conductive rubber layers and electrically non-conductive rubber layers, stacked alternately in a stripe-like fashion.

A circuit holder 22 is installed on the rear side of the clock circuit substrate 16, and on the rear side of the circuit holder 22, a secondary cell 17 for storing electric energy generated by the solar cell 8 is held by a cell holder 18.

After fixedly holding the solar cell 8, the dial 14, the liquid crystal display panel 50, and the light source 66 with a panel holder 21, and fixedly holding the hand drive substrate 15, and the clock circuit substrate 16 with the circuit holder 22, the panel holder 21 and the circuit holder 22 are mutually fitted to each other, thereby completing the timepiece unit 7 comprising the solar cell.

Electrodes of the respective power generation units 39 installed on the solar cell substrate 31 of the solar cell 8 are connected with the clock circuit substrate 16 via a zebra rubber 43 formed with electrically conductive rubber layers and electrically non-conductive rubber layers stacked alternately in a stripe-like fashion, through a spacing between a side of the first and second time display units, respectively, and the inner side wall of the timepiece case 1.

Herein the construction of the solar cell 8 for use in this embodiment is described in more details.

As shown in FIG. 3, with the solar cell 8, the multitude of the power generation units 39 as well as the transmitting portions 40 are patterned in alternate stripes on the solar cell substrate 31 in a disk shape, formed of a transparent material such as a glass material in a thin sheet form. The transmitting portions 40 have a transmittance in the visible light range, larger than that for the power generation units 39. In the case of this embodiment, the transmitting portions 40 are nearly transparent.

Figure 4:
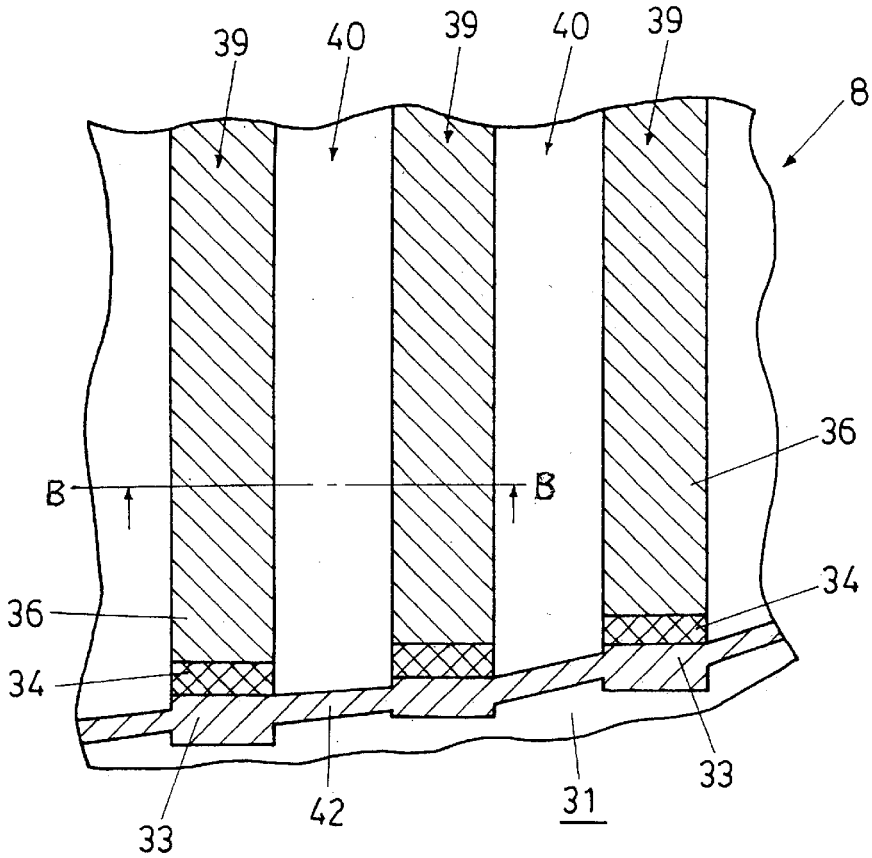
FIG. 4 is a partly enlarged schematic plan view of the solar cell.
Figure 5:
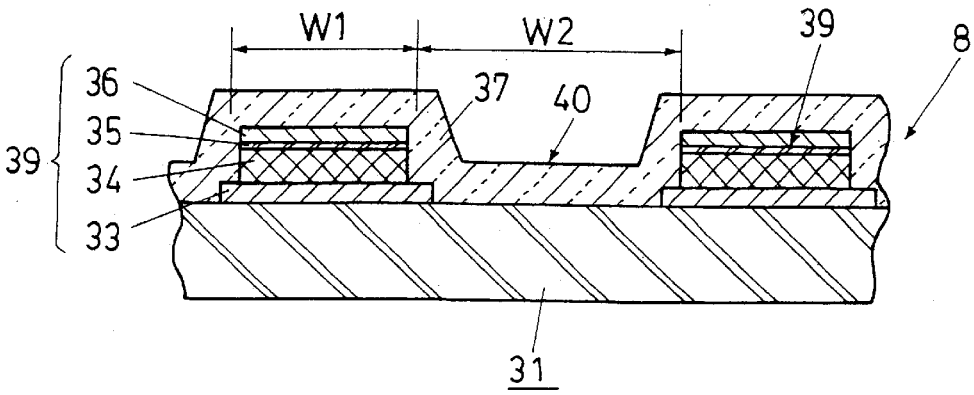
FIG. 5 is an enlarged schematic sectional view taken along line B—B of FIG. 4.
Figure 6:
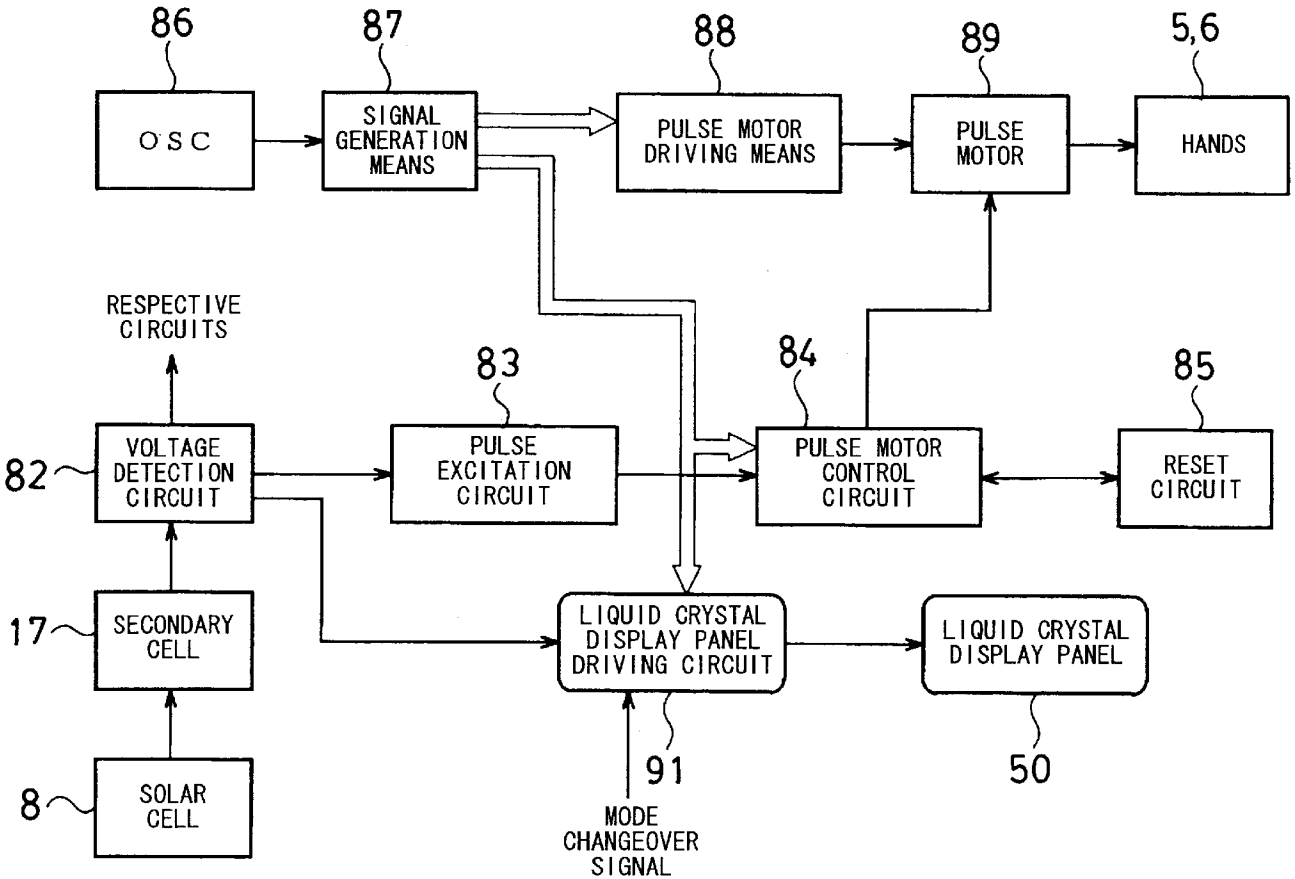
FIG. 6 is a block diagram showing a circuit configuration of the first embodiment of the timepiece according to the invention.

The respective power generation units 39, as shown in FIGS. 4 and 5 by enlarging parts thereof, are comprised of a lower electrode 33 which is a first electrode, a photovoltaic layer 34, and an upper electrode 36 which is a second electrode, formed in a strip-like shape and stacked up in that order so as to be superimposed on each other on the solar cell substrate 31.

More specifically, a transparent and electrically conductive film as the lower electrode (first electrode) 33 is formed on the solar cell substrate 31, an amorphous silicon (a—Si) film having a PIN junction as the photovoltaic layer 34 is formed on the lower electrode 33, and the upper electrode (second electrode) 36 made up of an aluminum film is formed on the photovoltaic layer 34 with a buffer layer 35 interposed therebetween.

The upper electrode 36 is preferably formed of an electrode material having a large reflectance, however, in order to prevent occurrence of deterioration in power generation efficiency due to mutual diffusion occurring between the upper electrode 36 and the photovoltaic layer 34, the buffer layer 35 composed of titanium oxide (TiOx) is installed therebetween.

As shown in FIG. 5, the buffer layer 35 and the photovoltaic layer 34 are patterned such that both sides thereof are flush with those of the upper electrode 36, which can be implemented with ease by etching the buffer layer 35 and the photovoltaic layer 34 using the upper electrode 36 as an etching mask.

With the use of such a process, the power generation units 39 can be easily formed to a width W1 on the order of 100

μm while minimizing a decrease in a width W2 of the transmitting portions 40.

With this embodiment, the width W2 of the transmitting portions 40 is set at 150 μm. Further, a protective layer 37 formed of polyimide resin is provided on the solar cell substrate 31 and the respective power generation units 39 for protection of the respective power generation units 39.

With this embodiment, polyimide resin is in use for the protective layer 37, however, by use of an anti-reflection coating formed by depositing magnesium fluoride ($MgF_2$) having a large refractive index on silicon oxide ($SiO_2$) having a small refractive index for the protective layer 37, the difference in refractive index between the solar cell substrate 31 and air can be decreased, and reflection at the interface therebetween is prevented, thereby enabling a transmittance to be improved by about 3%.

Further, the transmittance can be further improved by providing the front and rear faces of the solar cell substrate 31 with the anti-reflection coating as the protective layer.

With the adoption of a construction wherein the glass 2 is bonded to the solar cell substrate 31 with, for example, an acrylic adhesive having a large transmittance, although not adopted in this embodiment, in combination with the use of the protective layer 37 doubling as the anti-reflection coating, it is possible to improve the transmittance by 5% or more.

Further, bonding of the glass 2 to the solar cell substrate 31 results in the formation of a construction effective for protection of the solar cell substrate 31 from external impact.

As shown in FIGS. 3 and 4, the respective power generation units 39 patterned in stripes are connected with each other by a lower electrode group 42 on the rim of the solar cell substrate 31 via the respective lower electrodes 33. The lower electrode group 42 has a second pad electrode 46 for connection with the clock circuit substrate 16.

Similarly, the respective upper electrodes 36 are connected with each other by an upper electrode group 41 on the rim of the solar cell substrate 31. The upper electrode group 41 has a first pad electrode 45 for connection with the clock circuit substrate 16.

The first pad electrode 45 and the second pad electrode 46 are connected with respective terminals of the clock circuit substrate 16 via the zebra rubber 43 passing by the side of the dial 14 and the liquid crystal display panel 50 as shown in FIG. 2.

In the case of using a thin sheet glass material for the solar cell substrate 31, use of a soft zebra rubber is important from the viewpoint of prevention of cracking, including reliability of the timepiece. As the solar cell substrate 31 is disposed on the side of the glass, a protective film (not shown) for prevention of cracking is laminated to either the front face or the rear face of the solar cell substrate 31 in the case of the first embodiment.

Further, the solar cell substrate 31 is provided with an alignment portion 30 as shown in FIG. 3 for aligning the first and second pad electrodes 45, 46 with the clock circuit substrate 16.

With this embodiment, a notch is provided as the alignment portion 30, however, the alignment portion 30 may be a pattern or a protrusion which is provided at the same time when the power generation units are provided.

With the timepiece comprising the solar cell according to this embodiment, the solar cell 8 in whole, including the power generation units 39, is disposed on the visible side (on the side of the glass 2) of both the dial 14, the minute hand 5 and the hour hand 6 composing the first time display unit, and the liquid crystal display panel 50 composing the second time display unit. However, since the respective power generation units 39 of the solar cell 8 are patterned in the shape of a narrow stripe, and are disposed alternately with the respective transmitting portions 40 which are substantially transparent, with the result that, an area ratio of the transmitting portions 40 is higher than that of the power generation units 39, visibility of the respective time display units will not be impaired. Furthermore, since the power generation units 39 are hardly conspicuous, there is no need of installing a shielding film, and consequently, satisfactory power generation efficiency of the solar cell can be obtained without introducing restrictions on the design feature of the timepiece.

In the case of forming the power generation units 39 in a shape approximating to a rectangle having the longer sides and shorter sides, it is possible to ensure the transmittance on the order of 30%, and also to lower visibility of the power generation units 39 by setting a width size of the shorter sides thereof to 200 μm or less, and a width size of the transmitting portions 40 to 100 μm or more.

Further, if a width of the shorter sides of the power generation units 39 is set to 100 μm or less, and a width of the transmitting portions 40 is set to 100 μm or more in order to enhance a transmittance of partial power generation and transmitting units comprised of the respective power generation units 39 and the respective transmitting portions 40 and to improve the display quality of the time display units, this is very effective because visibility of the power generation units 39 can be further lowered in this case.

That is, the more the transmittance of the partial power generation and transmitting units comprised of the respective power generation units 39 and the respective transmitting portions 40 is enhanced, the more visibility of the time display units can be enhanced and the more the visibility of the power generation units 39 can be lowered, however, the power generation efficiency deteriorates.

Conversely, the more the transmittance of the partial power generation and transmitting units is lowered, the less a quantity of external light falling on the time display units becomes, thereby indicating darker display, and lowering the visibility of the time display units while increasing the visibility of the power generation units 39, however, although the power generation efficiency is enhanced.

Accordingly, taking into consideration the visibility of the time display units indoors, the power generation efficiency, and power consumption of the timepiece, the transmittance of the partial power generation and transmitting units is set in a range of 30 to 80%, thereby enabling display of the time display units to be sufficiently seen through the partial power generation and transmitting units.

Further, by providing regions where the transmittance of the partial power generation and transmitting units varies depending on a design and display contents of the time display units installed on the rear side of the solar cell 8, an area ratio of the transmitting portions is increased in parts where importance is attached to brightness, and an area ratio of the power generation units is increased in other parts where importance is attached to the power generation efficiency, so that the design feature and the power generation efficiency is optimally set Next, referring to a block diagram shown in FIG. 6, a time display operation of the timepiece according to the first embodiment is described hereinafter.

Electric energy generated by the solar cell 8 is stored (charged) in the secondary cell 17. An amount of electricity charged in the secondary cell 17 is detected by a voltage detection circuit 82. If a detected voltage is found to be at a specified value or higher, electric power delivered from the secondary cell 17 is supplied to respective circuits.

Thereafter, a time reference signal generated by an oscillation circuit (OSC) 86 is inputted to a time signal generation means 87 to generate a time signal in order to operate the hour hand 6 and the minute hand 5, and a pulse motor 89 is driven by a pulse motor driving means 88 according to the time signal, thereby rotating the hands, that is, the minute hand 5 and the hour hand 6, so that time is displayed by the hands in combination with the hour numerals on the dial 14.

Further, the time signal generated by the time signal generation means 87 is inputted to a liquid crystal display panel driving circuit 91 as well, and the liquid crystal display panel 50 is driven by the liquid crystal display panel driving circuit 91, thereby enabling time and a calendar to be displayed on the multiple function display portion 25. In such a case, a display mode can be changed over by a mode changeover signal inputted to the liquid crystal display panel driving circuit 91 according to manipulation of the mode adjustment button 28 shown in FIG. 1.

Further, a signal sent out from the liquid crystal display panel driving circuit 91 can be controlled by detected information of the voltage detection circuit 82, and thereby a waveform of a voltage applied to the liquid crystal display panel 50 is controlled, thus enabling a display state of the liquid crystal display panel 50 to be changed. For example, if the detected voltage becomes lower than a preset voltage, power consumption by the liquid crystal display panel 50 is reduced by reducing or eliminating an amount of display information of the liquid crystal display panel 50 according to a detection signal sent out from the voltage detection circuit 82.

Thus, with the timepiece according to this embodiment, the display state of the liquid crystal display panel 50 is rendered variable depending on a power generation condition of the solar cell 8 or a charged condition of the secondary cell 17.

Further, if the detected voltage of the voltage detection circuit 82 becomes lower than another preset voltage, a pulse excitation circuit 83 is activated by a signal from the voltage detection circuit 82, and a pulse motor control circuit 84 is actuated, thereby aiming at reduction of power consumption by stopping a pulse motor 89 or intermittently driving the same by skipping over pulse steps.

In the meantime, the time signal from the time signal generation means 87 is stored in a reset circuit 85 via the pulse motor control circuit 84, and when the detected voltage of the voltage detection circuit 82 rises due to an increase in the amount of electric energy generated by the solar cell 8, the pulse motor control circuit 84 drives the pulse motor 89 according to data stored in the reset circuit 85, thereby correctively rotating the minute hand 5 and the hour hand 6 so as to indicate a present time. In this way, a correct time is again displayed.

Figure 7:
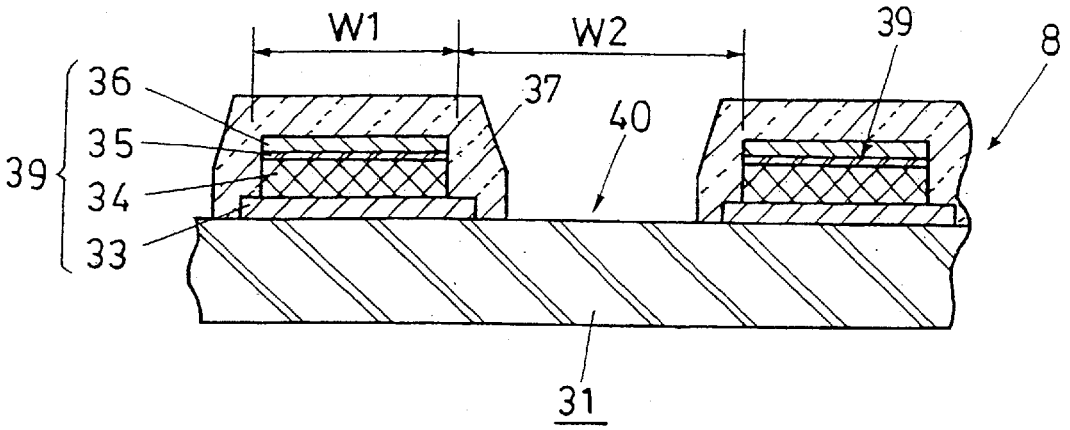
FIG. 7 is a partly enlarged schematic sectional view of a solar cell, similar to FIG. 5, assembled into a second embodiment of a timepiece according to the invention.

Second Embodiment: FIG. 7

Next, the construction of a solar cell used in a second embodiment of a timepiece according to the invention is described hereinafter with reference to FIG. 7. FIG. 7 is a partly enlarged schematic sectional view of the solar cell, similar to FIG. 5, and in the figure, parts corresponding to those in FIG. 5 are denoted by like reference numerals.

As with the solar cell shown in FIG. 5, the solar cell 8 of this embodiment as well comprises power generation units 39 and transmitting portions 40 patterned in alternate stripes on a solar cell substrate 31. The respective power generation units 39 are comprised of a lower electrode 33 made up of a transparent and electrically conductive film, a photovoltaic layer 34 made up of an amorphous silicon (a—Si) film having a PIN junction, a buffer layer 35, and an upper electrode 36 made up of an aluminum film, which are provided on the solar cell substrate 31, stacked up in that order.

The buffer layer 35 and the photovoltaic layer 34 are patterned such that both sides thereof are flush with those of the upper electrode 36, which can be implemented with ease by etching the buffer layer 35 and the photovoltaic layer 34 using the upper electrode 36 as an etching mask.

The power generation units 39 are formed so as to have a width WI on the order of 100 $\mu$m while the transmitting portions 40 are formed so as to have a width W2 on the order of 150 $\mu$m.

Further, the protective layer 37 formed of polyimide resin is installed on the solar cell substrate 31 and the respective power generation units 39 for protection of the respective power generation units 39, however, with the second embodiment, a protective layer 37 is formed only in regions covering the power generation units 39 in order to enhance a transmittance of the respective transmitting portions 40, and to prevent coloring due to the protective layer 37 by removing the protective layer 37 over the respective transmitting portions 40.

In a method of removing the protective layer 37 over the respective transmitting portions 40, positive polyimide resin is used for the protective layer 37, and light is radiated from a face of the solar cell substrate 31, opposite from a face thereof with the protective layer 37 formed thereon, thereby leaving out the positive polyimide resin in portions of the solar cell substrate 31, not radiated by light.

Also, the construction of the solar cell can be modified with ease through a flow treatment of the polyimide resin by applying a heat treatment thereto such that a portion of the polyimide resin overflows onto the respective transmitting portions 40 from the respective power generation units 39.

Figure 8:
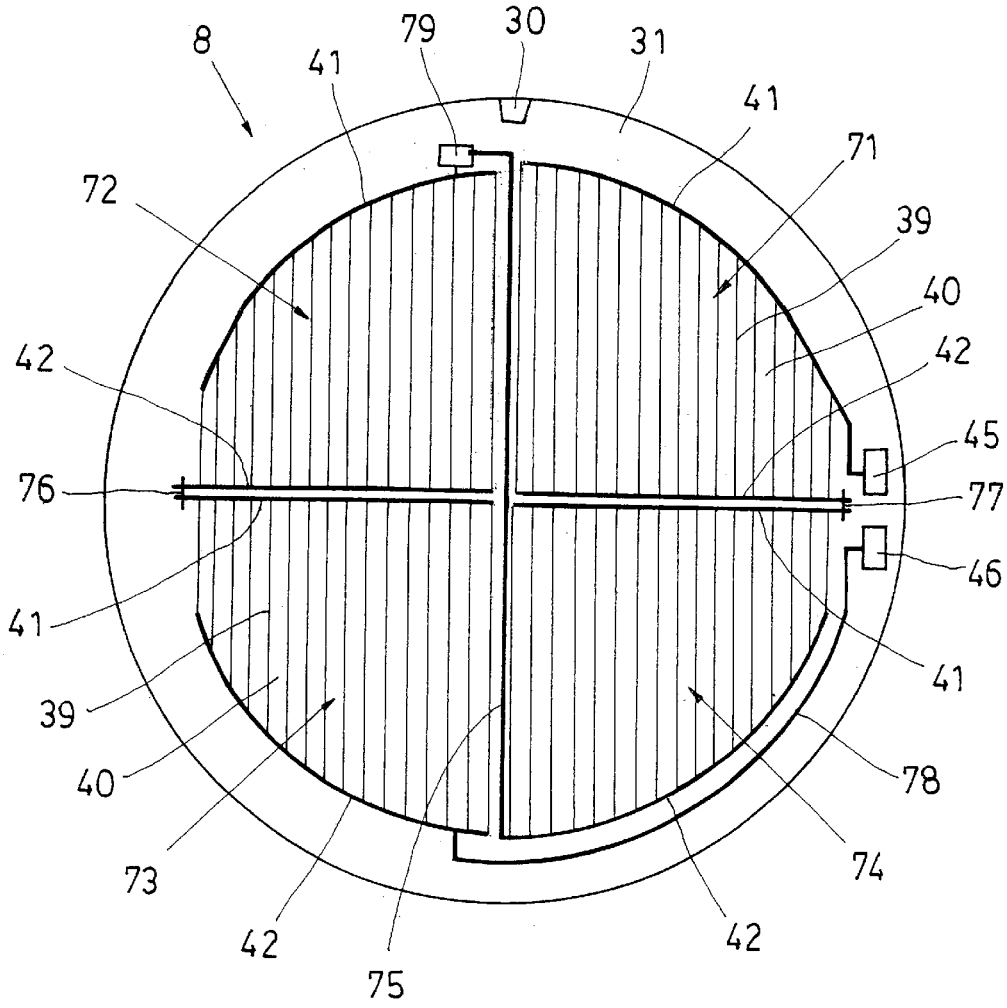
FIG. 8 is a plan view of a solar cell assembled into a third embodiment of a timepiece according to the invention.

Third Embodiment: FIG. 8

Subsequently, the construction of a solar cell used in a third embodiment of a timepiece according to the invention is described hereinafter with reference to FIG. 8. FIG. 8 is a plan view of the solar cell, similar to FIG. 3, and in the figure, parts corresponding to those in FIG. 3 are denoted by like reference numerals.

The solar cell 8 is constructed such that a power generation region thereof is divided into four power generation subregions, and power generation units in the four power generation subregions are connected in series.

The power generation units 39 and transmitting portions 40 are patterned in alternate stripes on a solar cell substrate 31. Similarly to the construction of the respective power generation units 39 of the solar cell 8, previously described with reference to FIGS. 5 and 7, the respective power generation units 39 according to this embodiment are comprised of a lower electrode, a photovoltaic layer made up of an amorphous silicon (a—Si) film having a PIN junction, and an upper electrode, which are formed so as to be stacked up in that order on a solar cell substrate 31.

A multitude of the power generation units 39 on the solar cell substrate 31 are disposed so as to be divided into four subregions, that is, a first power generation region 71, a second power generation region 72, a third power generation region 73, and a fourth power generation region 74.

Further, the lower electrodes 33 and the upper electrodes 36 are separated from each other, respectively, between the respective power generation regions. On the other hand, within the same power generation region, for example, in the first power generation region 71, the respective lower electrodes 33 are mutually connected with each other via a lower electrode group 42 while the respective upper electrodes 36 are mutually connected with each other via an upper electrode group 41. The same can be said of the second power generation region 72, the third power generation region 73, and the fourth power generation region 74.

The lower electrode group 42 of the first power generation region 71 is connected with an upper electrode group 41 of the fourth power generation region 74 via a first-fourth power generation region connection electrode 77. Further, the upper electrode group 41 of the first power generation region 71 is connected with a first electrode pad 45 for connection with a clock circuit substrate.

Further, a lower electrode group 42 of the fourth power generation region 74 is connected with an upper electrode group 41 of the second power generation region 72 via a second-fourth power generation region connection electrode 75 and a power generation region connection 79. A lower electrode group 42 of the second power generation region 72 is connected with an upper electrode group 41 of the third power generation region 73 by a second-third power generation region connection electrode 76. A lower electrode group 42 of the third power generation region 73 is connected with a second pad electrode 46 via a takeout electrode 78.

More specifically, between the first electrode pad 45 to be connected with the clock circuit substrate and the second pad electrode 46, connection from the first electrode pad 45 to the upper electrode group 41 in the first power generation region 71, the first power generation region 71, the lower electrode group 42 in the first power generation region 71, the first-fourth power generation region connection electrode 77, the upper electrode group 41 in the fourth power generation region 74, the fourth power generation region 74, the lower electrode group 42 in the fourth power generation region 74, the second-fourth power generation region connection electrode 75, the power generation region connection 79, the upper electrode group 41 in the second power generation region 72, the second power generation region 72, the lower electrode group 42 in the second power generation region 72, the second-third power generation region connection electrode 76, the upper electrode group 41 in the third power generation region 73, the third power generation region 73, the lower electrode group 42 in the third power generation region 73, and the takeout electrode 78, is made in series.

With the adoption of the configuration described above, a viewer is able to visually recognize through the solar cell substrate 31 display on a time display unit disposed on the rear side of the solar cell substrate 31 with the transmitting portions 40 interposed therebetween.

Further, with this embodiment, generated voltage of the solar cell 8 can be quadrupled by connecting in series the respective power generation units 39 of the four power generation regions 71 to 74. Since the generated voltage of the power generation units 39 in the respective power generation regions is on the order of 0.4V (volt) although it is dependent on intensity of light radiated to the solar cell 8, an output voltage at about 1.6V can be obtained.

That is, as a charge voltage applied to a secondary cell is increased, and thereby the output voltage of the solar cell 8 can be supplied to the secondary cell without boosting the same, energy loss due to boosting of the output voltage can be prevented.

Further, with the third embodiment of the invention, separation between the respective power generation regions is implemented along lines passing through the center of the solar cell substrate 31, however, in order to reduce visibility of portions of the solar cell substrate 31 where the power generation regions are separated from each other, separation along a straight line is preferably avoided by providing a recess and a protrusion in parts of the respective lower electrodes 33 or the respective upper electrodes 36 on a separating side of the respective power generation regions.

Furthermore, by selecting a width of the respective power generation units 39 within a range of from 100 to 50 $\mu$m by the unit of 10 $\mu$m, and by rendering a width of the respective transmitting portions 40 the same as that of the respective power generation units 39 in order to prevent non-uniformity in moire fringes from occurring due to presence of a slit between the respective power generation units 39 and the respective transmitting portions 40, occurrence thereof in fixed cycles can be prevented.

This can prevent occurrence of interference fringes caused by the stripes in which the power generation units 39 and the transmitting portions 40 are patterned, respectively. Further, the rim of the solar cell substrate 31 is provided with an alignment portion 30 in the form of a notch.

Figure 9:
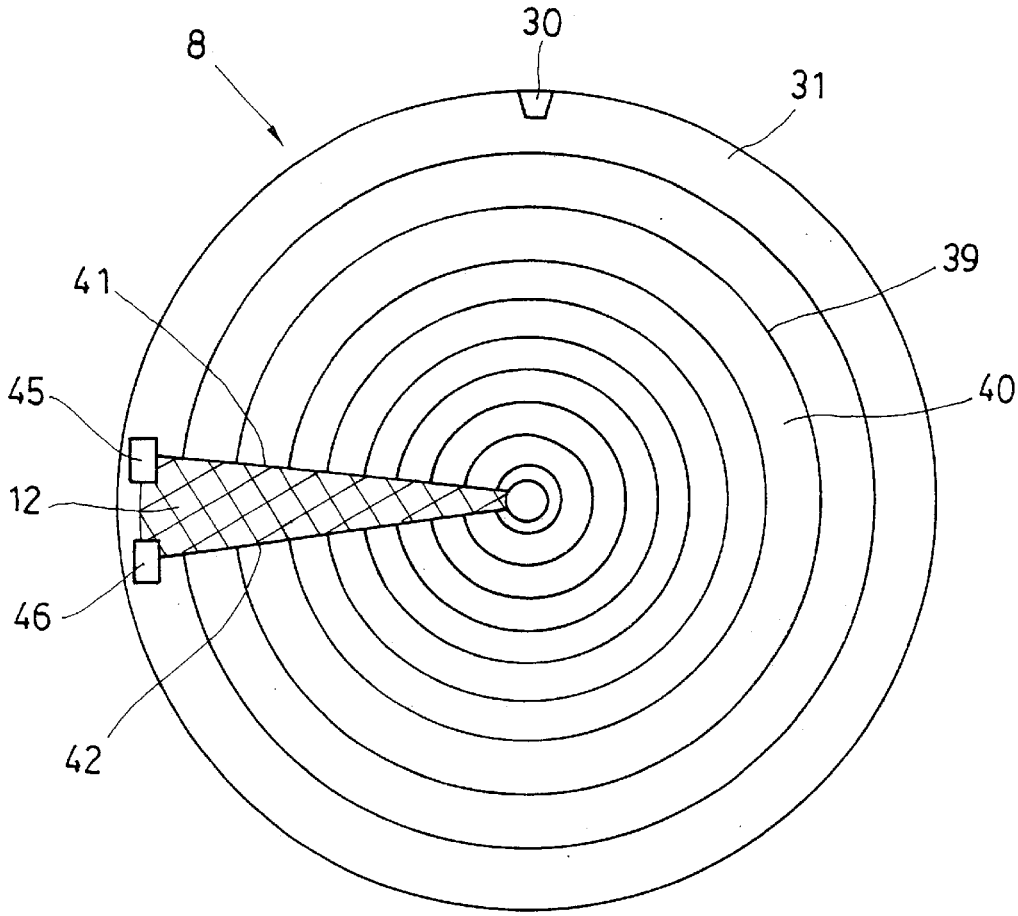
FIG. 9 is a plan view of a solar cell assembled into a fourth embodiment of a timepiece according to the invention.

Fourth Embodiment: FIG. 9

Subsequently, the construction of a solar cell used in a fourth embodiment of a timepiece according to the invention is described hereinafter with reference to FIG. 9. FIG. 9 is a plan view of the solar cell, similar to FIG. 3, and in the figure, parts corresponding to those in FIG. 3 are denoted by like reference numerals.

With the solar cell, power generation units are disposed so as to be patterned in concentric circles on a solar cell substrate, and a concentrical pattern is formed by the power generation units and transmitting portions, respectively.

That is, the power generation units 39 and the transmitting portions 40 are patterned in concentrical stripes alternately on the solar cell substrate 31 of the solar cell 8. The power generation units 39 have the same sectional structure as that of the power generation units 39 of the solar cell 8 according to the first embodiment previously described with reference to FIG. 5.

The respective power generation units 39 are in the shape of a concentric circle cut at a part thereof, and upper electrodes 36 (refer to FIG. 5) of the power generation units 39 concentrical in shape are mutually connected with each other via an upper electrode group 41 extending in the radius direction along one end of a cut region of the power generation units 39, the upper electrode group 41 being connected with a first pad electrode 45 provided in the vicinity of the rim of the solar cell substrate 31.

Further, lower electrodes 33 (refer to FIG. 5) of the power generation units 39 concentrical in shape are mutually connected with each other via a lower electrode group 42 extending in the radius direction along the other end of the cut region of the power generation units 39, and the lower electrode group 42 is connected with a second pad electrode 46 provided in the vicinity of the rim of the solar cell substrate 31.

With the fourth embodiment, in order to improve power generation efficiency by increasing an area ratio of the power generation units 39 to the transmitting portions 40, a width of the power generation units 39 is set at 150 μm, and a width of the transmitting portions 40 is set at 100 μm.

As a result, a transmittance of the solar cell substrate 31 becomes lower while the pattern of the power generation units 39 becomes recognizable by a viewer, however, the power generation units 39 can be rendered a part of the design of the timepiece by disposing the same in concentric circles.

Further, by installing an insulation film (not shown) between the upper electrode group 41 and the lower electrode group 42, and further, by utilizing a multiple-layer wiring (not shown), it is possible to prevent processing steps from becoming more complex and prevent an increase in fabrication, so that a secondary cell for use in this embodiment can be fabricated by a conventional method of fabricating the solar cell.

Furthermore, a printed layer 12 is provided on the visible side of regions on the solar cell substrate 31, where the upper electrode group 41 and the lower electrode group 42 are installed. The printed layer 12 enables the solar cell to be incorporated into parts of the design of the timepiece.

Figure 10:
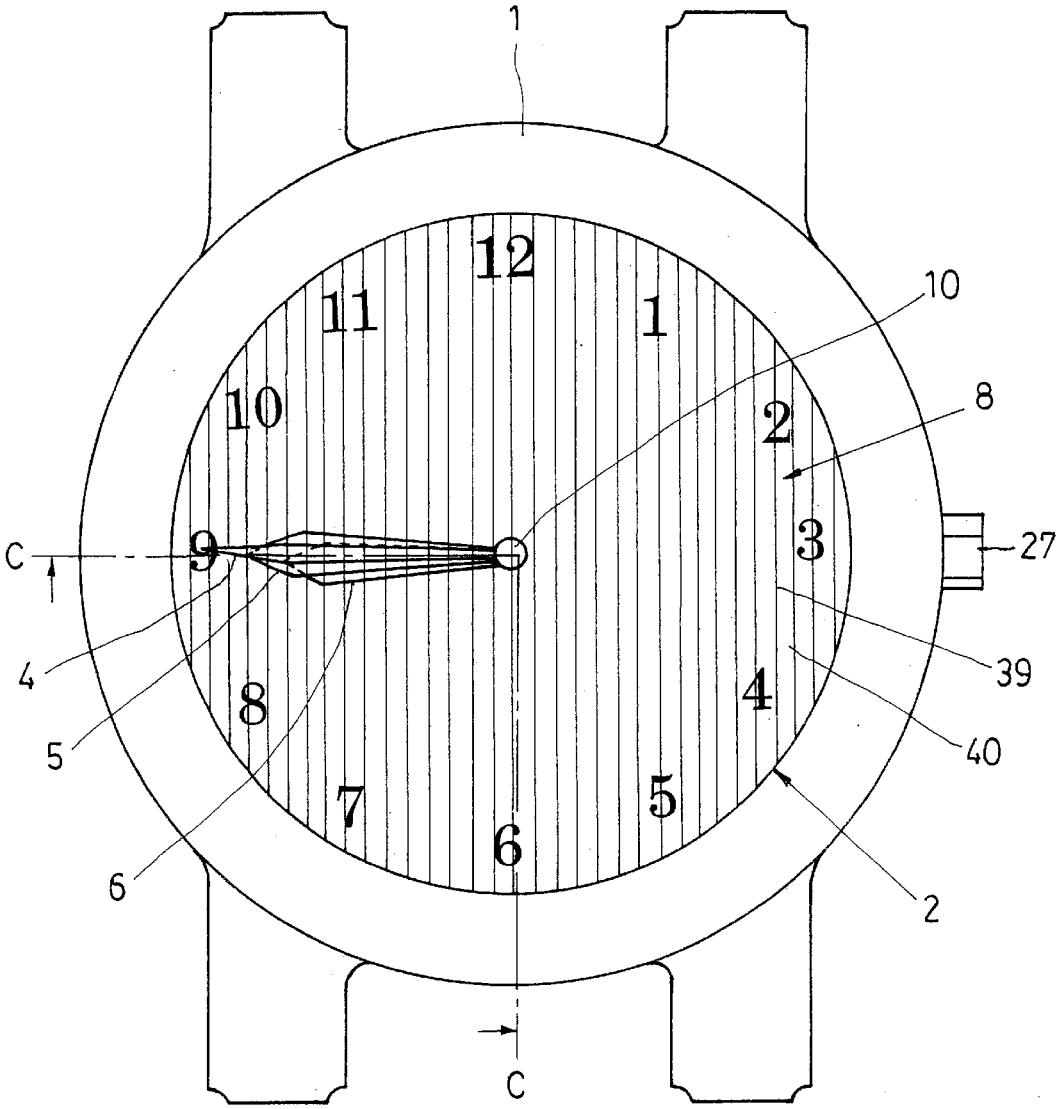
FIG. 10 is a schematic plan view showing a fifth embodiment of a timepiece according to the invention.
Figure 11:
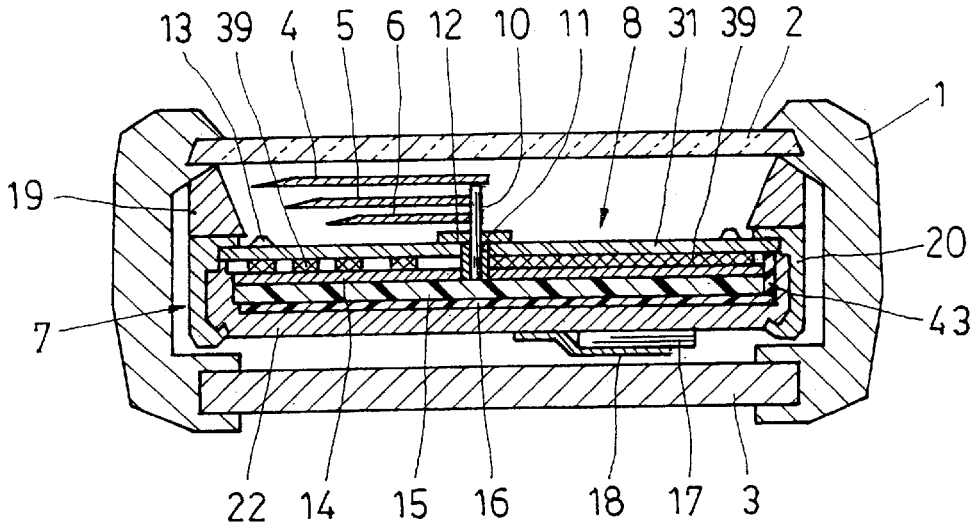
FIG. 11 is a schematic sectional view taken on line C—C of FIG. 10.

Fifth Embodiment: FIGS. 10 and 11

Next, a fifth embodiment of a timepiece according to the invention is described hereinafter with reference to FIGS. 10 and 11. FIG. 10 is a plan view of the timepiece, similar to FIG. 1, and FIG. 11 a schematic sectional view taken along line C—C of FIG. 10. In these figures, parts corresponding to those in FIGS. 1 and 2 are denoted by like reference numerals.

The timepiece according to the fifth embodiment is characterized in that a solar cell is disposed between a dial composing an, analog time display unit and hands.

First, the solar cell assembled into the timepiece comprises power generation units 39 and transmitting portions 40 patterned in alternate stripes on a solar cell substrate 31 (on the underside thereof in FIG. 11). The power generation units 39 have the same structure as that of the power generation units 39 of the solar cell 8 according to the first embodiment previously described with reference to FIGS. 4 and 5.

The dial 14 is disposed on a hand drive substrate 15, and the solar cell 8 is disposed on the visible side of the dial 14. A hand shaft 10 installed on the hand drive substrate 15 is penetrated through a hand shaft through-hole 11, which is a through-hole formed in the dial 14 and the solar cell substrate 31, and is extended to the front side of the solar cell substrate 31, holding the hands, that is, the second hand 4, the minute hand 5, and the hour hand 6 at the tip thereof. It follows therefore that the solar cell 8 is disposed between the dial 14 and the hands (the second hand 4, the minute hand 5, and the hour hand 6). In this connection, the hand shaft 10 in fact comprises three shafts concentrically installed for the second hand 4, the minute hand 5, and the hour hand 6, respectively.

A clock circuit substrate 16 is installed on the rear side of the hand drive substrate 15, and the solar cell substrate 31, the dial 14, the hand drive substrate 15, and the clock circuit substrate 16 are held by an upper holder 20 and a circuit holder 22 which are fitted to each other, thereby making up a timepiece unit 7.

Pad electrodes installed on the solar cell substrate 31 are connected with terminals on the clock circuit substrate 16, respectively, by a zebra rubber 43. Electric energy generated by the solar cell 8 is delivered to the clock circuit substrate 16 via the zebra rubber 43.

A secondary cell 17 for storing electric energy generated by the solar cell is held on the rear side of the circuit holder 22 by a cell holder 18.

A timepiece unit 7 is housed in an enclosed space formed by a timepiece case 1, a glass 2, and a case back 3 as with the timepiece according to the first embodiment. However, with the timepiece according to the fifth embodiment, the timepiece unit 7 is not provided with a digital time display unit comprising a liquid crystal display panel.

Further, a dial ring is installed along the inner rim of the glass 2, and between the timepiece unit 7 and the timepiece case 1, thereby shielding the rim of the timepiece unit 7. The timepiece case 1 is provided with a time adjustment knob 27 on the rim thereof as shown in FIG. 10 for adjusting the analog time display unit.

The dial 14 disposed on the rear side of the solar cell substrate 31 has numerals, letters, or characters, and so forth, printed thereon in multiple colors, and has a rough surface with fine asperities formed thereon. As a result, diffuse reflection light bounced from the dial 14 strikes at the power generation units 39 of the solar cell 8, thereby enabling power generation efficiency to be enhanced.

Further, a printed layer 12 is provided on the surface of the solar cell substrate 31 in order to shield the hand shaft through-hole 11. The printed layer 12 may be provided by printing with a color paint, or by bonding a plating film to the surface of the solar cell substrate 31 with an adhesive layer.

Furthermore, a design printed layer 13 is provided on the solar cell substrate 31, in the vicinity of the numerals or letters on the dial 14. The design printed layer 13 is provided for the purpose of causing the letters and so forth on the dial 14 installed on the rear side of the solar cell substrate 31 to be three-dimensionally seen when looking at the letters and so forth from the visible side by taking advantage of parallax existing to the extent of a thickness of the solar cell substrate 31.

More specifically, the design printed layer 13 provided on the solar cell substrate 31 and a printed layer having the letters and so forth on the dial 14 are disposed so as to be superimposed on each other, and there is provided a spacing to the extent of the thickness of the solar cell substrate 31 between the design printed layer 13 on the solar cell substrate 31 and the printed layer on the dial 14, so that the printed layer on the dial 14 is rendered recognizable from the visible side through the transmitting portions 40.

Taking advantage of lowering of a transmittance of the solar cell substrate 31, caused by the power generation units 39, it is also possible in this case to implement the diversification of design feature of the timepiece due to the difference in contrast between the dial 14 and the design printed layer 13.

Figure 12:
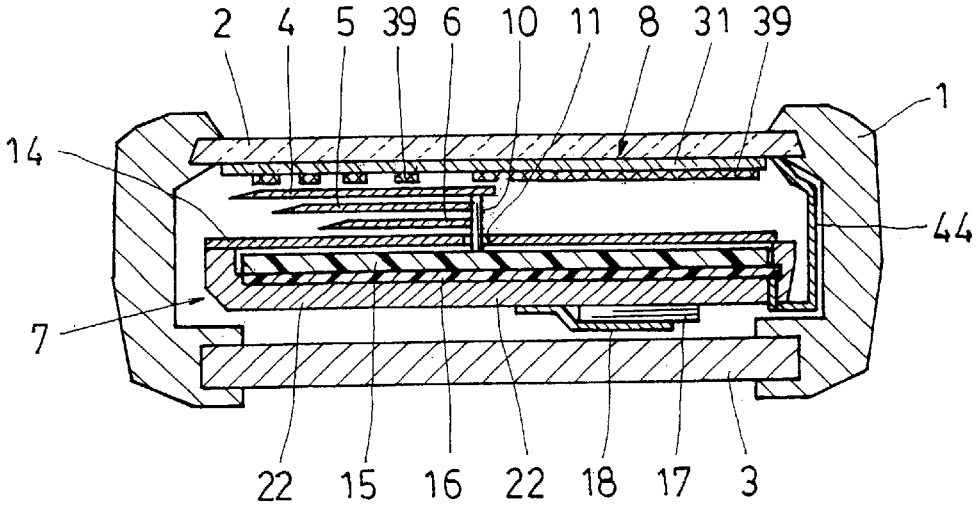
FIG. 12 is a schematic sectional view, similar to FIG. 11, showing a sixth embodiment of a timepiece according to the invention.

Sixth Embodiment: FIG. 12

Subsequently, a sixth embodiment of a timepiece according to the invention is described hereinafter with reference to FIG. 12. FIG. 12 is a sectional view of the timepiece similar to FIG. 11, and in the figure, parts corresponding to those in FIG. 11 are denoted by like reference numerals, omitting description thereof.

The timepiece according to the sixth embodiment differs mainly from the timepiece according to the fifth embodiment described above in that a solar cell 8 is disposed between a time display unit of an analog type, comprising a dial 14 and hands (the second hand 4, the minute hand 5, and the hour hand 6), and a glass 2, and a face of a solar cell substrate 31 on a side thereof opposite from a face thereof on which power generation units 39 are installed is stuck onto the glass 2.

The solar cell 8 comprises the power generation units 39 and transmitting portions 40, the same in construction as those for the respective embodiments described in the foregoing, which are patterned in alternate stripes on the rear face of the solar cell substrate 31 made of sapphire glass or crystal glass, 1 mm or more in thickness. With the respective power generation units 39, a photovoltaic layer provided between a lower electrode and an upper electrode may be of a multiplelayer tandem type.

The upper face of the solar cell substrate 31 of the solar cell 8 is stuck onto the inner face of the glass 2 made up of sapphire glass or crystal glass with a transparent adhesive.

With such a construction, it is possible to considerably reduce the risk of the solar cell substrate 31 formed of a thin glass sheet being broken by external impact, and also to prevent power generation efficiency of the power generation units 39 from deteriorating due to deformation of the solar cell substrate 31.

Further, pad electrodes provided on the solar cell substrate 31 of the solar cell 8 are connected with terminals on a clock circuit substrate 16, respectively, via a flexible printed circuit (FPC) board 44 installed along the inner wall of a timepiece case 1, and electric energy generated by the solar cell 8 is delivered to the clock circuit substrate 16 via the FPC board 44.

The FPC board 44 can be housed even in a scant gap between a timepiece unit 7 and the timepiece case 1. Further, even if there exists a long interval between the pad electrodes on the solar cell substrate 31 and the terminals on the clock circuit substrate 16, connection therebetween can be easily implemented.

In other respects, the construction and operation of the timepiece are the same as those for the timepiece according to the fifth embodiment, shown in FIG. 11, omitting description thereof.

Figure 13:
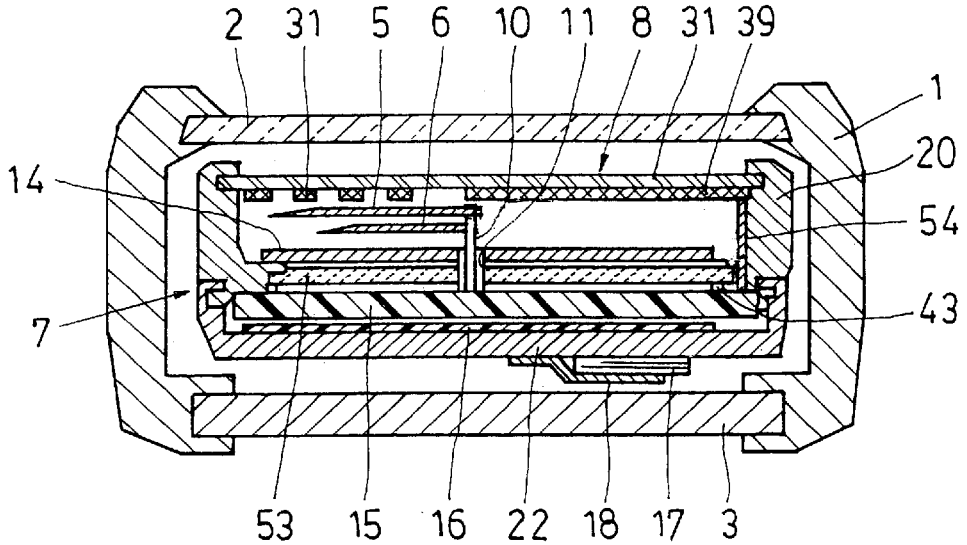
FIG. 13 is a schematic sectional view, similar to FIG. 11, showing a seventh embodiment of a timepiece according to the invention.

Seventh Embodiment: FIG. 13

Next, a seventh embodiment of a timepiece according to the invention is described hereinafter with reference to FIG. 13. FIG. 13 is a sectional view of the timepiece similar to FIG. 11, and in the figure, parts corresponding to those in FIG. 11 are denoted by like reference numerals.

The timepiece according to the seventh embodiment differs mainly from the timepiece according to the first, fifth, and sixth embodiments described above, respectively, in that a solar cell 8 is disposed between a time display unit of an analog type, comprising a dial 14 and hands (the minute hand 5, and the hour hand 6), and a glass 2, and an auxiliary solar cell 53 is also disposed between the dial 14 and a hand drive substrate 15 installed on the rear side thereof.

With the auxiliary solar cell 53, a ratio of an area occupied by power generation units on a solar cell substrate thereof is increased.

Further, since no transmitting property is required of the auxiliary solar cell 53, a metal substrate can be used for the solar cell substrate thereof. With the auxiliary solar cell 53, the power generation units (not shown) may comprise transmitting electrodes installed on the front side thereof.

For connection of pad electrodes on the solar cell substrate 31 of the solar cell 8 with terminals on a clock circuit substrate 16, respectively, a spring 54 having elasticity is used.

Further, for connection of pad electrodes on the auxiliary solar cell 53 with the clock circuit substrate 16, a zebra rubber 43 is used because of a shorter distance therebetween.

With the timepiece according to the seventh embodiment, an amount of power generated can be increased due to use of two sheets of the solar cells.

Other Embodiments

The respective embodiments described in the foregoing may be carried out after applying various modifications thereto as follows.

The solar cell 8 incorporated in the timepiece according to the invention may be constructed by stacking up a plurality of solar cell substrates 31, each having power generation units 39 and transmitting portions 40, one after another, such that the respective transmitting portions 40 on the plurality of the solar cell substrates 31 are superimposed on each other.

A printed layer having numerals or letters may be formed on the solar cell substrate 31 and the printed layer may be a printed layer covered with a plurality of colors.

Further, a repeat pitch of the stripes in which the power generation units 39 and the transmitting portions 40 provided on the solar cell substrates 31 are patterned may be varied (differentiated) according to a display region of the time display unit.

Also, at least a portion of the power generation units 39 provided on the solar cell substrates 31 may incorporate shapes of numerals or letters.

In order to prevent occurrence of moire fringes, the repeat pitch or a repeat direction of the respective power generation units 39 as well as the respective transmitting portions 40 provided on the solar cell substrates 31 are preferably differentiated from directions (repeat direction of letters, lines, and so forth) on the time display unit as indicated by the dial 14 or the liquid crystal display panel 50 thereof, or a pitch of the printed layer.

Furthermore, for effective radiation of light to the power generation units 39, an optical guide film or a lens is preferably installed between the solar cell substrates 31 and the dial 14.

INDUSTRIAL APPLICABILITY

As is evident from the foregoing description, with the timepiece incorporating the solar cell, according to the invention, the solar cell in whole, including the power generation units, is disposed on the visible side of the time display unit of the timepiece, however, such configuration does not impair visibility of the time display unit, and the power generation units remain inconspicuous even without installation of a shielding film, so that satisfactory power generation efficiency of the solar cell is obtained without introducing restrictions on the design feature of the timepiece.

Accordingly, with various types of timepieces including an electronic wrist watch incorporating a solar cell, wherein replacement of the solar cell is unnecessitated, it becomes possible to enhance visibility of display, and also to implement the diversification of the design of a timepiece.

What is claimed is:

1. A timepiece comprising a time display unit, and a solar cell comprised of a solar cell substrate, and a power generation unit having at least a first electrode, a photovoltaic layer, and a second electrode, stacked up in that order so as to be superimposed on each other on the solar cell substrate, using electric power generated by the solar cell as an energy source for executing time display in the time display unit, wherein said solar cell is composed such that the solar cell substrate is composed of a transparent material, a plurality of the power generation means are patterned and provided on the solar cell substrate, and transmitting portions having a large transmittance in a visible light range are provided between the plurality of the power generation means, the solar cell is disposed on a visible side of the time display unit so as to be superimposed on the time display unit, the power generating units and the transmitting portions are superimposed on the time display unit, and the time display region is rendered to be recognized through the transmitting regions.

2. A timepiece according to claim 1, wherein the time display unit comprises a dial and hands, and the solar cell is disposed on a visible side of the dial.

3. A timepiece according to claim 2, wherein the solar cell is disposed between the dial and the hands.

4. A timepiece according to claim 1, wherein the plurality of the power generation units being connected with each other via the respective first electrodes and the respective second electrodes, and the solar cell is disposed between the time display unit and a glass of the timepiece.

5. A timepiece according to claim 4, wherein the solar cell comprises the respective power generation units and the respective transmitting portions disposed alternately on the solar cell substrate, and has regions where visibility of partial power generation and transmitting units comprised of the respective power generation units in combination with the respective transmitting portions is in a range of 30 to 80%, thereby enabling a condition on an underside of the solar cell substrate to be seen in the regions from a viewer's side.

6. A timepiece according to claim 4, wherein the solar cell is constructed such that an area ratio of the respective power generation units installed on the solar cell substrate to the respective transmitting portions adjoining the respective power generation units varies depending on a region on the solar cell substrate.

7. A timepiece according to claim 4, wherein the solar cell is constructed such that a plurality of solar cell substrates are disposed therein, and an area ratio of the respective power generation units installed on each of the solar cell substrates to the respective transmitting portions adjoining the respective power generation units varies depending on the solar cell substrates.

8. A timepiece according to claim 1, wherein the solar cell is constructed such that a plurality of solar cell substrates, each having the power generation unit and the transmitting portion, are stacked up one after another, and are disposed such that transmitting portions of the plurality of the solar cell substrates are superimposed on each other.

9. A timepiece according to claim 4, wherein the solar cell is constructed such that a plurality of solar cell substrates, each having the power generation units and the transmitting portions, are stacked up one after another, and are disposed such that the transmitting portions of the plurality of the solar cell substrates are superimposed on each other.

10. A timepiece according to claim 1, wherein the solar cell comprises a printed layer having numerals or letters, provided on the solar cell substrate.

11. A timepiece according to claim 4, wherein the solar cell comprises a printed layer having numerals or letters, provided on the solar cell substrate.

12. A timepiece according to claim 10, wherein the printed layer is a printed layer printed with a plurality of colors.

13. A timepiece according to claim 11, wherein the printed layer is a printed layer printed with a plurality of colors.

14. A timepiece according to claim 2, wherein the solar cell comprises a design printed layer having numerals or letters, provided on the solar cell substrate, and a printed layer provided on the dial as well, the design printed layer on the solar cell substrate and the printed layer on the dial are disposed so as to be substantially superimposed on each other, and a spacing to the extent of a thickness of the solar cell substrate is provided between the design printed layer on the solar cell substrate and the printed layer on the dial, the printed layer on the dial is rendered recognizable from the visible side through the transmitting portion of the solar cell substrate.

15. A timepiece according to claim 4, wherein the time display unit comprises a dial and hands, the solar cell is disposed on a visible side of the dial, the solar cell comprises a design printed layer having numerals or letters, provided on the solar cell substrate, and a printed layer provided on the dial as well, the design printed layer on the solar cell substrate and the printed layer on the dial are disposed so as to be substantially superimposed on each other, and a spacing to the extent of a thickness of the solar cell substrate is provided between the design printed layer on the solar cell substrate and the printed layer on the dial, the printed layer on the dial is rendered recognizable from the visible side through the transmitting portion of the solar cell substrate.

16. A timepiece according to claim 4, wherein the respective power generation units and the respective transmitting portions, provided on the solar cell substrate of the solar cell, are repeatedly disposed in a pattern of stripes.

17. A timepiece according to claim 4, wherein the respective power generation units and the respective transmitting portions, provided on the solar cell substrate of the solar cell, are repeatedly disposed in a pattern of stripes, and a repeat pitch of the pattern of the stripes is varied.

18. A timepiece according to claim 2, wherein at least a portion of the power generation unit provided on the solar cell substrate of the solar cell incorporates shapes of numerals or letters.

19. A timepiece according to claim 4, wherein at least a portion of the power generation units provided on the solar cell substrate of the solar cell incorporates shapes of numerals or letters.

20. A timepiece according to claim 4, wherein the plurality of the power generation units and the transmitting portions, provided on the solar cell substrate of the solar cell, are patterned in concentric circles, and each of the plurality of the power generation units is in a shape of a concentric circle cut at a part thereof, the plurality of the power generation units being mutually connected with each other at the cut part of the respective concentric circles.

21. A timepiece according to claim 1, having a construction wherein the first electrode and the second electrode, installed on the solar cell substrate of the solar cell, composing the power generation unit, are connected with a clock circuit substrate for causing the time display unit to execute time display through a spacing between a side of the time display unit and the inner side wall of a timepiece case.

22. A timepiece according to claim 1, having a construction wherein the first electrode and the second electrode, installed on the solar cell substrate of the solar cell, composing the power generation unit, are connected with a clock circuit substrate for causing the time display unit to execute time display via an electrically conductive rubber disposed so as to pass through a spacing between a side of the time display unit and the inner side wall of a timepiece case.

23. A timepiece according to claim 1, having a construction wherein the first electrode and the second electrode, installed on the solar cell substrate of the solar cell, composing the power generation unit, are connected with a clock circuit substrate for causing the time display unit to execute time display via a flexible printed circuit board disposed so as to pass through a spacing between a side of the time display unit and the inner side wall of a timepiece case.

24. A timepiece according to claim 1, having a construction wherein the first electrode and the second electrode, installed on the solar cell substrate of the solar cell, composing the power generation unit, are connected with a clock circuit substrate for causing the time display unit to execute time display via a spring disposed so as to pass through a spacing between a side of the time display unit and the inner side wall of a timepiece case.

25. A timepiece according to claim 1, wherein the time display unit comprises both an analog time display unit for displaying time with hands and a dial, and a digital time display unit for displaying time and a calendar with numerals.

26. A timepiece according to claim 25, wherein the digital time display unit is comprised of a liquid crystal display panel.

27. A timepiece according to claim 26, wherein the liquid crystal display panel comprises a reflection type polarizing film having one polarization axis which is a transmission axis and the other polarization axis which is a reflection axis, substantially orthogonal to the transmission axis.

28. A timepiece according to claim 26, wherein a light source is installed on a side of the liquid crystal display panel, opposite from a visible side.

29. A timepiece according to claim 2, wherein the solar cell substrate is provided with a through-hole through which a hand shaft serving as a rotatory shaft of the hands is penetrated.

30. A timepiece according to claim 29, further comprising a printed layer provided around the through-hole in the solar cell substrate.

31. A timepiece according to claim 1, wherein the solar cell substrate is provided with an alignment portion used for alignment.

32. A timepiece according to claim 1, wherein a printed layer having numerals or letters is provided on the solar cell substrate, and an alignment portion used for alignment with the time display unit is also provided on the solar cell substrate.

33. A timepiece according to claim 1, wherein a repeat pitch or a repeat direction of the respective power generation units as well as the respective transmitting portions, provided on the solar cell substrates, is differentiated from a direction of a display part or a pitch of a printed layer provided on the time display unit for prevention of occurrence of moire fringes.

34. A timepiece according to claim 1, wherein the power generation unit of the solar cell is installed on a face of the solar cell substrate, on a side thereof, facing the time display unit.

35. A timepiece according to claim 21, wherein a pad electrode serving as a terminal of the first electrode and the second electrode, respectively, composing the power generation unit, is installed on a face of the solar cell substrate, on a side thereof, facing the clock circuit substrate.

36. A timepiece according to claim 1, wherein a protective layer or a protective film is provided on at least either of front and rear faces of the solar cell substrate.

37. A timepiece according to claim 1, wherein either of front and rear faces of the solar cell substrate is stuck onto a glass of the timepiece.

38. A timepiece according to claim 1, wherein an anti-reflection layer is installed on at least the transmitting portion of the solar cell substrate.

39. A timepiece according to claim 2, wherein an optical guide film or a lens is installed between the solar cell substrate and the dial for effectively radiating light to the power generation unit.

40. A timepiece according to claim 2, wherein the surface of the dial has a rough face formed for effectively radiating light to the power generation unit of the solar cell substrate.

41. A timepiece according to claim 2, wherein the surface of the dial is provided with a printed layer formed for effectively radiating light to the power generation unit of the solar cell substrate.

42. A timepiece according to claim 1, wherein two types of solar cells, one of which has an area ratio of the power generation unit to the transmitting portion, installed on the solar cell substrate, differing from the same of the other, are installed across the time display unit on both sides thereof, respectively.

* * * * *